US009516439B2

(12) United States Patent
Westergaard et al.

(10) Patent No.: US 9,516,439 B2
(45) **Date of Patent: *Dec. 6, 2016**

(54) HEARING AID FITTING SYSTEM AND A METHOD OF FITTING A HEARING AID SYSTEM

(71) Applicant: Widex A/S, Lynge (DK)

(72) Inventors: Anders Westergaard, Herlev (DK); Svend Vitting Andersen, Humlebak (DK)

(73) Assignee: Widex A/S, Lynge (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/740,837

(22) Filed: Jun. 16, 2015

(65) Prior Publication Data

US 2015/0281863 A1 Oct. 1, 2015

Related U.S. Application Data

(63) Continuation-in-part of application No. PCT/EP2012/076570, filed on Dec. 21, 2012.

(51) Int. Cl.
*H04R 25/00* (2006.01)

(52) U.S. Cl.
CPC ..... *H04R 25/70* (2013.01); *H04R 25/554* (2013.01); *H04R 2225/55* (2013.01)

(58) Field of Classification Search
CPC ..... H04R 25/70; H04R 25/554
USPC ..... 381/60, 312, 314, 315, 316, 328, 59, 320,381/321; 700/94; 702/122; 703/2; 710/64; 713/1
See application file for complete search history.

(56) References Cited

U.S. PATENT DOCUMENTS 5,303,306 A * 4/1994 Brillhart ..... H04R 25/558 381/312
5,710,819 A * 1/1998 Tøpholm ..... H04R 25/556 381/312
5,721,783 A * 2/1998 Anderson ..... H04B 1/385 381/312
6,424,722 B1 * 7/2002 Hagen ..... H04R 25/70 381/314
6,522,988 B1 * 2/2003 Hou ..... A61B 5/121 702/108

(Continued)

FOREIGN PATENT DOCUMENTS

DE 19600234 A1 7/1997
DE 29905172 U1 7/1999

(Continued)

OTHER PUBLICATIONS

International Preliminary Report on Patentability—Written Opinion of the International Searching Authority for PCT/EP2012/076570 dated Jun. 23, 2015.

(Continued)

*Primary Examiner* — Gerald Gauthier
(74) *Attorney, Agent, or Firm* — Sughrue Mion, PLLC

(57) ABSTRACT

A hearing aid fitting system (100, 200, 300) adapted for remote fitting of a hearing aid system (110), wherein a direct communication channel between a hearing aid fitting part and an external device (102, 302), adapted to communicate directly with the hearing aid system (110), is established by a control server (103) based on unique identifications of the hearing aid fitting part, the external device and the hearing aid fitter. The invention also provides a method of remote fitting of a hearing aid system.

16 Claims, 4 Drawing Sheets

(56) References Cited

U.S. PATENT DOCUMENTS 6,851,048 B2 * 2/2005 Armitage ..... H04R 25/70 381/314
8,050,435 B2 * 11/2011 Nishizaki ..... H04R 25/70 381/312
8,111,850 B2 * 2/2012 Messmer ..... H04R 25/70 381/320
8,243,972 B2 * 8/2012 Latzel ..... H04R 25/70 381/23.1
8,731,205 B2 * 5/2014 Parker ..... H04R 25/606 381/59
8,792,661 B2 * 7/2014 Apfel ..... H04R 25/305 381/314
8,848,954 B2 * 9/2014 Balke ..... H04R 25/70 381/312
9,100,491 B2 * 8/2015 Bang ..... H04M 1/6016
9,107,015 B2 * 8/2015 Zhang ..... H04R 25/70
2001/0009019 A1 * 7/2001 Armitage ..... H04R 25/70 710/64
2004/0028250 A1 * 2/2004 Shim ..... H04R 25/70 381/312
2005/0283263 A1 * 12/2005 Eaton ..... H04R 25/554 700/94
2007/0009126 A1 * 1/2007 Fischer ..... H04R 25/558 381/315
2007/0189545 A1 * 8/2007 Geiger ..... A61B 5/121 381/60
2007/0255435 A1 * 11/2007 Cohen ..... H04R 1/1016 700/94
2008/0037798 A1 * 2/2008 Baechler ..... H04R 25/30 381/60
2011/0082520 A1 4/2011 McElveen, Jr.
2011/0106508 A1 * 5/2011 Boretzki ..... H04R 25/554 703/2
2011/0176686 A1 * 7/2011 Zaccaria ..... H04R 25/70 381/60
2012/0183164 A1 7/2012 Foo et al.
2014/0334629 A1 * 11/2014 Andersen ..... H04R 25/70 381/60
2015/0281863 A1 * 10/2015 Westergaard ..... H04R 25/70 381/60

FOREIGN PATENT DOCUMENTS

WO 2007/020299 A2 2/2007
WO 2007/144435 A2 12/2007
WO 2011/128462 A2 10/2011

OTHER PUBLICATIONS

International Search Report for PCT/EP2012/076570 dated Jan. 8, 2013.

* cited by examiner

HEARING AID FITTING SYSTEM AND A METHOD OF FITTING A HEARING AID SYSTEM

RELATED APPLICATIONS

The present application is a continuation-in-part of application PCT/EP2012076570, filed on 21 Dec. 2012, in Europe, and published as WO 2014094866 A1.

BACKGROUND OF THE INVENTION

1. Field of the Invention

The present invention relates to hearing aid fitting systems. The present invention also relates to a method of fitting a hearing aid system.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

In a traditional hearing aid fitting clinic, each hearing aid fitter has his own office, and the user's hearing aids are adjusted using the fitting equipment that the hearing aid fitter has in his office. Typically the fitting equipment comprises a computer capable of executing the relevant hearing aid programming software and a programming device adapted to provide the link between the computer and the hearing aid.

Some hearing aid users may have special preferences or suffer from a hearing loss type that requires assistance from a hearing aid fitter with highly specialized competences.

In these cases the hearing aid user will have to travel to this specific hearing aid fitter, which may be difficult and expensive for the hearing aid user.

In a traditional hearing aid fitting clinic, a single hearing aid fitter is responsible for the whole fitting procedure. Since many hearing aid fitters possess highly specialized knowledge of fitting certain types of hearing loss or fitting certain features of the hearing aid, then the traditional fitting procedure may not always be the optimal solution.

2. The Prior Art

Various types of remote fitting may assist in providing a more flexible hearing aid fitting procedure, and methods for remote fitting of hearing aids have been proposed in the art.

DE-A1-19600234 discloses a method of fitting a hearing aid, wherein data are transmitted from the fitting equipment and to the hearing aid using a remote data transmission link such that the hearing aid fitting can be carried out practically independent of the distance between the hearing aid user and the hearing aid fitter. In one embodiment the system comprises two computers that are connected using an ISDN link and in another embodiment one of the two computers comprises means for transforming the data, received over the transmission link, into a data format that can be understood by the hearing aid.

DE-U1-29905172 discloses a programming device that can be coupled directly to a telephone line, a modem or a computer, whereby data can be transmitted to and from the programming device. The programming device is adapted to access and adjust the setting of a hearing aid. In this way the hearing aid fitter can adjust the setting of a distant hearing aid using the programming device and a telephone line for providing the data transmission link between the programming device and the fitting software located within the hearing aid fitter's office.

WO-A2-2011/128462 discloses a method for providing distant support to a plurality of personal hearing aid users. Prior to a support session, users are paired with providers by storing a pairing information, and when starting a support session, the stored pairing information is used to determine a support provider. According to a preferred embodiment data exchanged between the user computer and the supporter computer is relayed by a relay server, whereby both user and support provider may be located behind a firewall.

The embodiments disclosed in WO-A2-2011/128462 are disadvantageous in that they require the hearing aid user to start an application software that may have to be installed on the user's computer and establish a data connection between the personal hearing system and the user computer.

It is a feature of the present invention to provide a method of fitting a hearing aid system that in an efficient manner allows the various parts of the hearing aid fitting procedure to be carried out by fitting personnel with different core competences.

It is another feature of the present invention to provide a method of fitting a hearing aid system that allows fitting personnel with different geographical locations to carry out the hearing aid fitting procedure together in a flexible manner.

It is yet another feature of the present invention to provide a hearing aid fitting system that allows the hearing aid fitting procedure to be carried out by a multitude of persons located in different geographical locations.

SUMMARY OF THE INVENTION

The invention, in a first aspect, provides a hearing aid fitting system, adapted for remote fitting of a hearing aid, comprising a client, an external device, a control server, look-up means, and link means, wherein the client, external device, control server, look-up means and hearing aid are adapted to communicate by link means; wherein said look-up means is adapted to allow a unique device identification to be searched based on a multitude of search term types; wherein said client comprises fitting software adapted to fit a hearing aid, selection means, adapted to select a unique device identification using said look-up means, and connection software means adapted to connect to said control server, to provide to said control server a current computer network address of the client, the selected unique device identification and a hearing aid fitter identification, and to request said control server to establish a direct communication channel between said client and the external device having said unique device identification for the person holding said fitter identification; wherein the external device comprises a unique device identification, external device software application means adapted to provide said unique device identification and a current computer network address of the external device to said control server, and redirecting means adapted to direct the content of the data transmitted over said direct communication channel to the hearing aid system; wherein said control server comprises interface means adapted to provide the direct communication channel between the client and the external device based on the current computer network addresses and the selected unique device identification and based on an evaluation of whether the hearing aid fitter holding said hearing aid fitter identification is entitled to access the external device having said unique device identification.

This provides a hearing aid fitting system that allows the hearing aid fitting procedure to be carried out by a multitude of persons located in different geographical locations.

The invention, in a second aspect, provides a method of fitting a hearing aid system comprising the steps of providing a client, a look-up means, an external device, a control server and a hearing aid system; using the client and the look-up means to select a unique device identification; using the client to provide the selected device identification, a current computer network address of the client and a hearing aid fitter identification to the control server; using the external device to provide the unique device identification and a current computer network address of the external device to the control server; using said client to request the control server to establish a direct communication channel between the client and the external device; using the control server to evaluate whether the hearing aid fitter holding said hearing aid fitter identification is entitled to access the external device having said unique device identification; using the control server to establish the direct communication channel between the client and the external device; and using the client, the direct communication channel and the external device to remotely fit the hearing aid system.

This provides an improved method of remotely fitting a hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Within the present context the terms internet, computer network and local area network may be used interchangeable. It is a common feature that devices connected to either of these computer networks can be accessed based on a network address.

In a first aspect the inventors have found a hearing aid fitting system that allows any hearing fitter, independent of geographical location, to carry out at least part of the hearing aid fitting procedure.

In a second aspect the inventors have found a hearing aid fitting system that is extremely flexible and easy to use (provided a computer network such as the internet or a Local Area Network is available) insofar that the same hearing aid fitting system can be used independent on whether:

- the hearing aid user is located next to the fitter in the office of the hearing aid fitter;
- the user is at home and the fitter is at his office or anywhere else;
- the user is in one hearing clinic and the fitter is in another room in the same clinic or in another clinic or at home; or
- the hearing aid user wants to fine tune his hearing aid without the assistance of a fitter.

Figure 1:
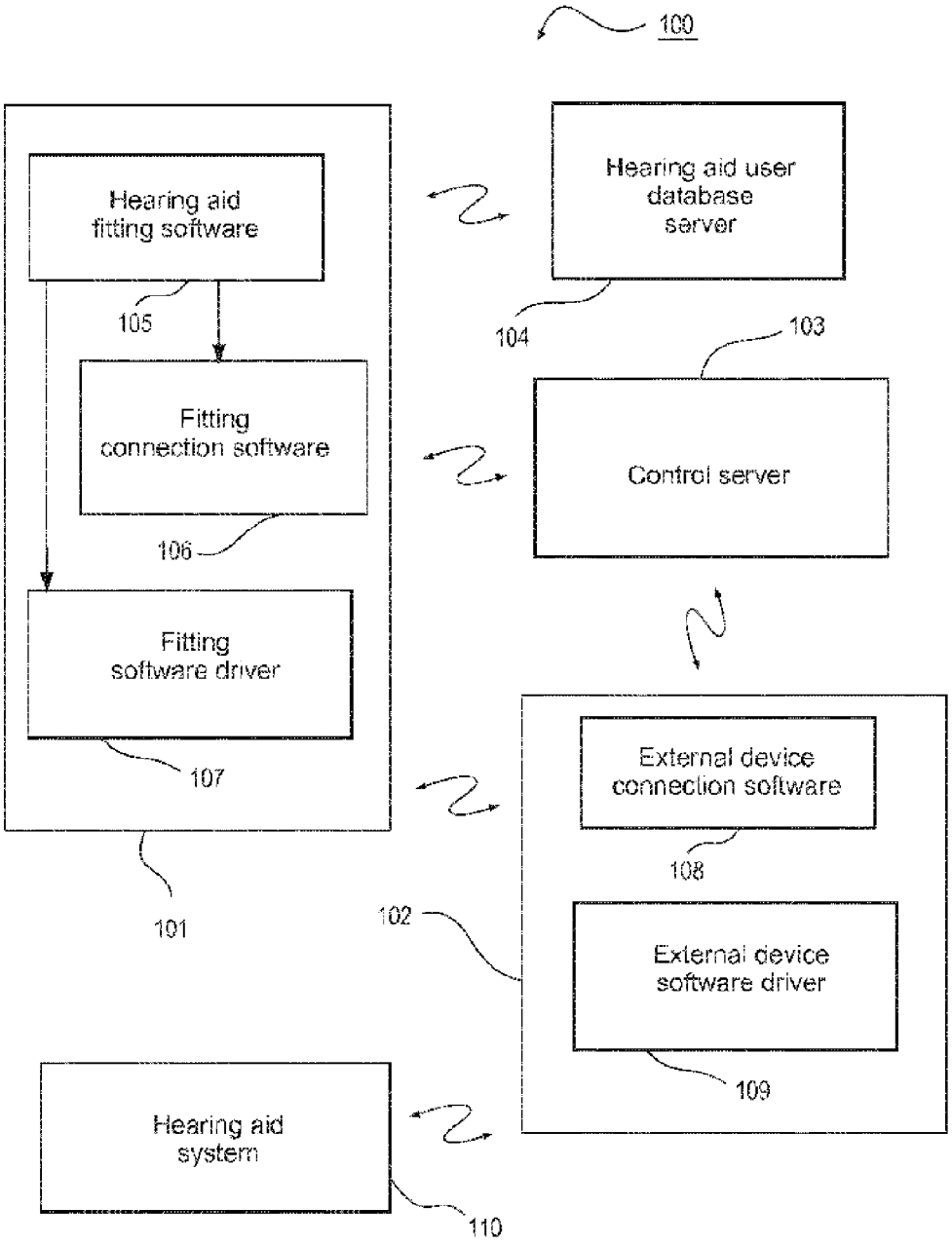
FIG. 1 illustrates highly schematically a hearing aid fitting system according to a first embodiment of the invention.

Reference is first made to FIG. 1, which illustrates highly schematically a hearing aid fitting system 100 according to a first embodiment of the invention. The hearing aid fitting system 100 comprises a client 101, an external device 102, a control server 103, a hearing aid user database server 104 and a hearing aid system 110.

The client 101 further comprises hearing aid fitting software 105, a fitting connection software 106 and a fitting software driver 107. The external device 102 comprises an external device connection software 108 and an external device software driver 109.

The individual components of the hearing aid fitting system 100 are further described below through an explanation of the method steps carried out in a hearing aid fitting session according to an embodiment of the invention.

A hearing aid fitter is at his office in the clinic, at home or somewhere else where a client and internet access is available.

The control server 103 comprises a look-up database that holds pairs of unique external device identifications and searchable names of different types that allow the hearing aid fitter to find the desired external device in a simple and efficient manner. The searchable names may be of the type "hearing aid user" for those external devices that are assigned to one specific user, may be of the type "clinic" for those external devices that are owned and used by a specific clinic, may be of the type "hearing aid fitter" for those devices that are owned by a specific hearing aid fitter or may be of the type "public institution" for those devices that are located in public institutions such as libraries, hospitals or other governmental institutions.

The external devices of the types "clinic" and "public institution" may have names that comprise more information than just the clinic or public institution name, e.g. "clinic-1" and "clinic-2" or "clinic-room1" and "clinic-room2" and so on.

This structure of the look-up database ensures that the hearing aid fitter can locate a specific external device in a fast and efficient manner.

A service provider maintaining the control server 103 may provide said pairing information to the look-up database on the control server 103, but a hearing aid fitter may also provide this information directly to the look-up database on the control server 103 when a hearing aid user receives his own external device or when a hearing fitter assigns an external device to be his own personal device or to be assigned to a specific clinic and possibly even a specific location or purpose in that clinic.

It is a specific advantage of the present invention that the external device 102 is operated in exactly the same manner independent of whether it is used by a hearing aid user or a hearing aid fitter or whether it is used at home or in a hearing aid clinic. When the external device 102 is powered up and connected to a computer network the external device connection software 108 establishes contact to the control server 103, reports that the external device is online and provides the unique external device identification and the current computer network address. Basically these steps can be carried out at any time prior to the fitting. When a hearing aid system 110 is positioned within wireless range of the external device 102 the external device connection software 108 also establishes contact to the hearing aid system 110.

It is a specific advantage of the present invention that the pairing information stored in the control server does not have to be updated, if e.g. the hearing aid user replaces his hearing aid system, because it is the external device identification that is stored.

It adds to the complexity of the external device and the hearing aid system if the external device is adapted to read out a unique hearing aid system identification from the hearing aid system 110. However, in variations of the FIG. 1 embodiment the unique external device identification is replaced by a unique hearing aid system identification that is read out from the hearing aid system by the external device.

In the following the generic term unique device identification may be used to denote both the unique hearing aid system identification and the unique external device identification.

In a next step the hearing aid fitter, using the hearing aid fitting software 105, accesses a hearing aid user database server 104 and selects an entry for a hearing aid user, for whom fitting of a hearing aid system 100 is to be carried out. A unique hearing aid user identification code is assigned to each hearing aid user. The hearing aid user database server 104 comprises for each hearing aid user data such as hearing loss, and details concerning current and prior fittings or in other words the information required for starting the fitting procedure. Having these data loaded into the hearing aid fitting software 105, the fitting connection software 106 establishes contact to the control server 103 and provides the current computer network address of the client 101 to the control server 103. The user of the client 101 then selects an unique external device identification, using said look-up database and the control server 103 is requested to establish a direct communication channel, between the client 101 and the selected external device 102 and hereby to the hearing aid system 110.

In order to avoid unauthorized access the hearing aid fitter logs on to the control server 103 using a log-on and a password. According to variations of the present embodiment the log on process needs not be carried out from within the hearing aid fitting system. According to a further variation access to the control server 103 may not be restricted because access to use the external devices can be restricted instead. In yet other variations it may for some hearing aid fitting systems not be necessary with restricted access. This may be the case for e.g. hearing aid fitting systems directed only at external devices located in public institutions.

According to other variations unauthorized access to carry out a remote hearing aid fitting is avoided by further adapting the fitting connection software 106 to provide to the control server a hearing aid fitter identification, and by further adapting the control server 103 to evaluate whether the hearing aid fitter having said hearing aid fitter identification is allowed to access a given external device defined by its unique device identification, and wherein the external device is adapted to allow storage of specific hearing aid fitter identifications, and wherein the interface means of the control server is adapted such that the evaluation, in order to allow access to the external device, comprises a comparison of the identification of a hearing aid fitter requesting access and a hearing aid fitter identification stored in the external device. In variations the hearing aid fitter or hearing aid user retrieves the hearing aid fitter identification, when logging into the hearing aid fitting software 105 using a special account (i.e. a log-on). In this manner the selected account determines the range of external devices that can be accessed.

According to further variations the information linking a hearing aid fitter identification with a specific device identification need not be stored in the external device, but may instead be stored elsewhere such as e.g. in the control server 103 or in a look-up database.

According to the embodiment of FIG. 1, the look-up database is located at the control server 103 and accessed from within the hearing aid fitting system; however this needs not necessarily be the case.

According to variations the look-up database comprises a separate database or a multitude of databases where each database comprises only a specific type of search terms. According to either of these variations the fitting connection software 106 establishes contact to a look-up database, based on the selected search type, retrieves a unique device identification, which is later provided to the control server 103 together with the computer network address of the client, and requests the establishment of a direct communication between the client and the external device.

According to yet another variation said look-up means is adapted such that some of the search terms allow a unique hearing aid system identification to be found while other of the search terms allow a unique external device identification to be found. In a further variation some of the search terms may even allow that either of the two identifications is searched for.

The inventors have found that the hearing aid fitting system according to various embodiments provides an advantageous combination of flexibility for the hearing aid fitter while also allowing access to the hearing aid system to be controlled in a simple and efficient manner.

One application of the hearing aid fitting system of the present invention comprises providing a hearing aid user with a personal external device. In this case the look-up database will link the hearing aid user name with the external device identification, and the access will typically be restricted to a single professional hearing aid fitter and the hearing aid user himself.

Another application of the hearing aid fitting system of the present invention comprises providing a hearing aid fitter with his own personal external device that he may carry with him if out travelling. In this case the look-up database will link the hearing aid fitter name with the external device identification, and the access will typically be restricted to the professional hearing aid fitter himself.

Yet another application of the hearing aid fitting system of the present invention comprises providing a public institution with an external device that may be accessed by a hearing aid user, by any one belonging to the society of professional hearing aid fitters or possibly only by hearing aid fitters with specialized competence in fitting a special brand of hearing aids. In this case the look-up database will link the type of hearing aid user and hearing aid fitter society with the external device identification and the access will be restricted to the hearing aid user and professional hearing aid fitters belonging to said society.

According to the embodiment of FIG. 1 the fitting software driver 107 transforms the protocol of the hearing aid fitting software data output from Universal Serial Bus (USB) to a network protocol, such as the User Datagram Protocol (UDP), and the external device software driver 109 transforms the received data from the client 101 from the network protocol and into a protocol suitable for transmitting the data to the hearing aid system 110. This latter protocol is normally a proprietary protocol that varies among the individual hearing aid system manufacturers.

According to the embodiment of FIG. 1 data from the external device 102 and to the hearing aid system 110 are transmitted using wireless link means. In variations the data may be transmitted without the use of wireless link means, i.e. over a wired connection.

In a variation according to the embodiment of FIG. 1 the external device 102 is adapted to be inserted directly into an Ethernet connection of a standard internet modem. However, basically any computer network connection of the modem can be used.

In a variation according to the embodiment of FIG. 1 the database server 104 is integrated as part of the client 101.

In a variation according to the embodiment of FIG. 1 data from the external device 102 and to the hearing aid system 110 are transmitted at least partly using wired link means.

In other variations according to the embodiment of FIG. 1 the software drivers 107 and 109 may be omitted in case the hearing aid fitting software 105 and the link means providing the data transmission between the client 101 and the external device 102 and between the external device 102 and to the hearing aid system 110 are set up to use the same protocol. In further variations only the software driver 107 may be omitted, in case the fitting software can provide output in a suitable network protocol, or only the software driver 109 may be omitted, in case the data transmission between the external device 102 and the hearing aid system 110 can use a suitable network protocol.

The hearing aid fitting system according to FIG. 1 is advantageous in that a remote fitting can be carried out in a simple manner even in the case where the hearing aid system 110 is protected behind a firewall since the direct communication channel is set up in response to a request from the external device 102 that is positioned behind said firewall together with the hearing aid system 110.

The hearing aid fitting system according to FIG. 1 is further advantageous in that a remote fitting can be carried out in a simple manner virtually independent of the selected fitting software platform through the use of the fitting connection software 106 and the fitting software driver 107.

The embodiment according to FIG. 1 is further advantageous in that it enables existing hearing aid fitting software to remotely fit existing hearing aid systems without having to modify the fitting software itself.

Furthermore the embodiment according to FIG. 1 is advantageous in that all that is required of the hearing aid user in order to enable the remote fitting according to the invention is to insert the external device 102 into a network connection and position the hearing aid system 110 within range of the wireless link means of the external device 102. Thus the external device 102 may be implemented as an embedded device.

Figure 2:
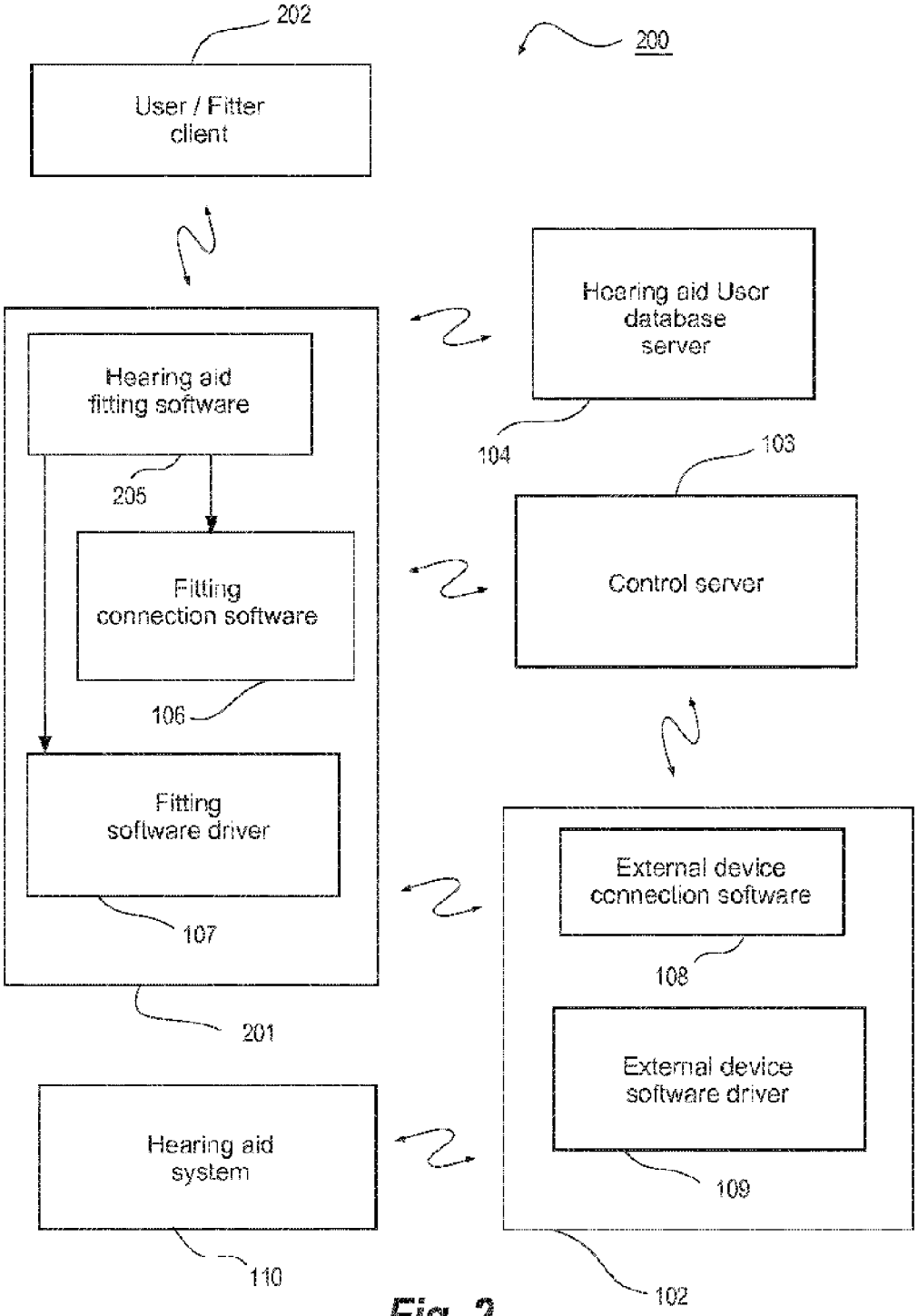
FIG. 2 illustrates highly schematically a hearing aid fitting system according to a second embodiment of the invention.

Reference is now made to FIG. 2, which illustrates highly schematically a hearing aid fitting system according to a second embodiment of the invention.

The hearing aid fitting system 200 of FIG. 2 comprises basically the same elements as the hearing aid fitting system 100 of FIG. 1, except that the client 101 is now split into a user client 202 and a hearing aid fitting server 201.

The user client 202 is a simple device having a web browser. The hearing aid fitting server 201 comprises the fitting connection software 106 and driver 107 already described with reference to FIG. 1 and the hearing aid fitting software 205 implemented as a web service such that no hearing aid fitting software needs to be installed on the user client 202—a web browser is all that is required in order to fit a hearing aid system using the user client 202. Especially the web service of the hearing aid fitting software 205 provides the graphical user interface to the user client 202.

The embodiment of FIG. 2 is especially advantageous in that the user client is a generic device that is platform independent and in that the communication between the user client 202 and the hearing aid fitting server 201 is independent of the selected platform for the hearing aid fitting server 201.

The user client 202 according to the embodiment of FIG. 2 can therefore be any type of web enabled device, such as a smart phone or tablet PC, independent of the operating system.

Figure 3:
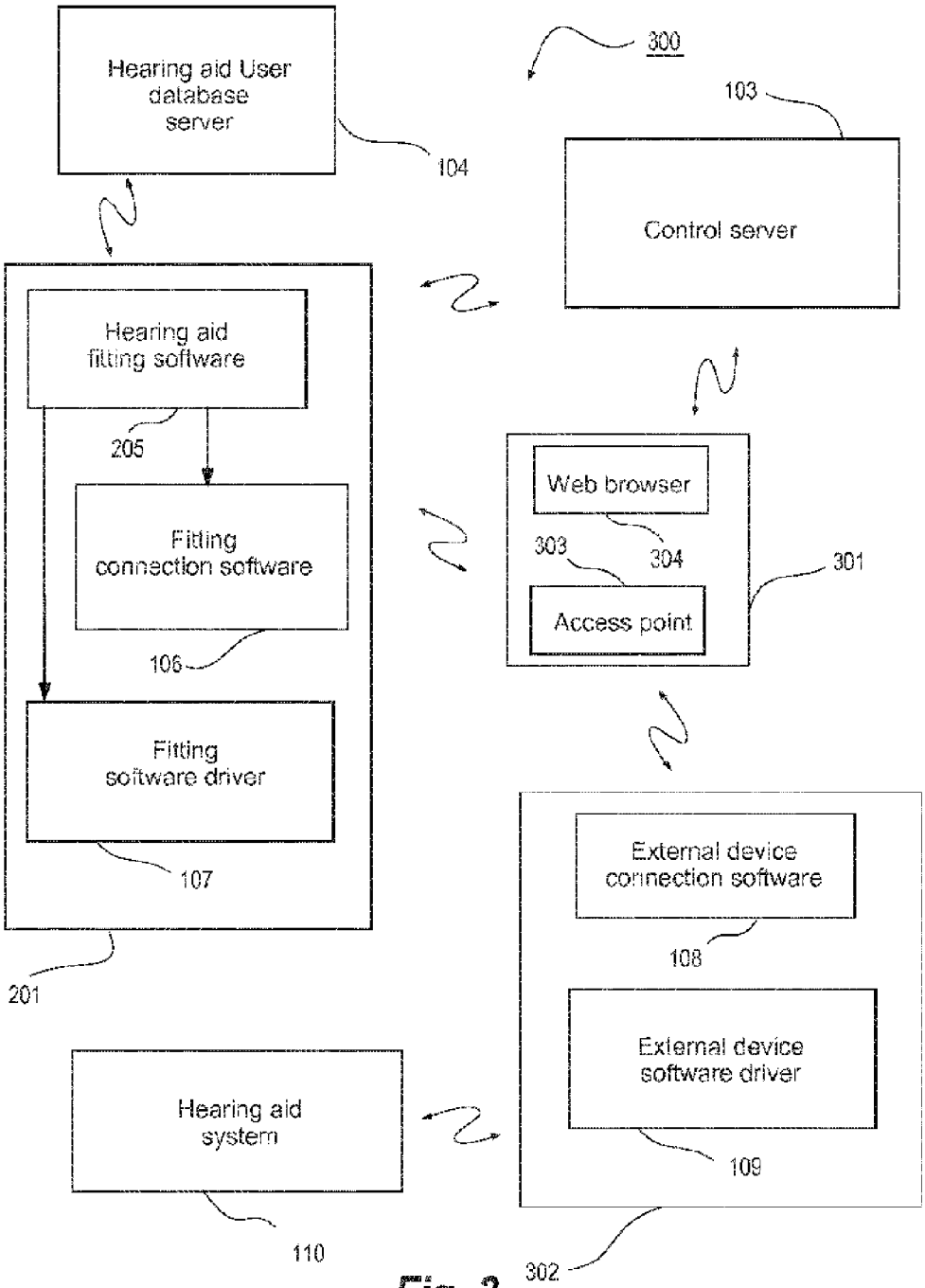
FIG. 3 illustrates highly schematically a hearing aid fitting system according to a third embodiment of the invention.

Reference is now made to FIG. 3, which illustrates highly schematically a hearing aid fitting system 300 according to a third embodiment of the invention.

The hearing aid fitting system 300 of FIG. 3 comprises basically the same elements as the hearing aid fitting system 200 of FIG. 2, except that the user client 301 in addition to the web browser 304 comprises a wireless access point 303 and that the external device 302 comprises wireless link means that enables the external device 302 to establish the initial contact to the control server 103 and the direct communication channel to the hearing aid fitting server 201 using the wireless access point 303 of the user client 301.

The embodiment of FIG. 3 is especially advantageous in that a hearing user only requires the user client 301, the external device 302 and internet access in order to fit a hearing aid system. The hearing aid fitting system 300 according to the embodiment of FIG. 3 does not require a modem because the external device 302 connects to the internet through the access point 303 of the user client 301.

According to a variation of the embodiment of FIG. 3 the user client 301 is a smart phone or a tablet PC.

In variations of the embodiment of FIG. 3 the external device 302 seeks to establish contact to the control server 103 as soon as the external device is powered up.

In a variation of the FIG. 2 and FIG. 3 embodiments the hearing aid fitting software 205 of the client 201 is distributed on a graphical user interface server and a hearing aid fitting server.

Figure 4:
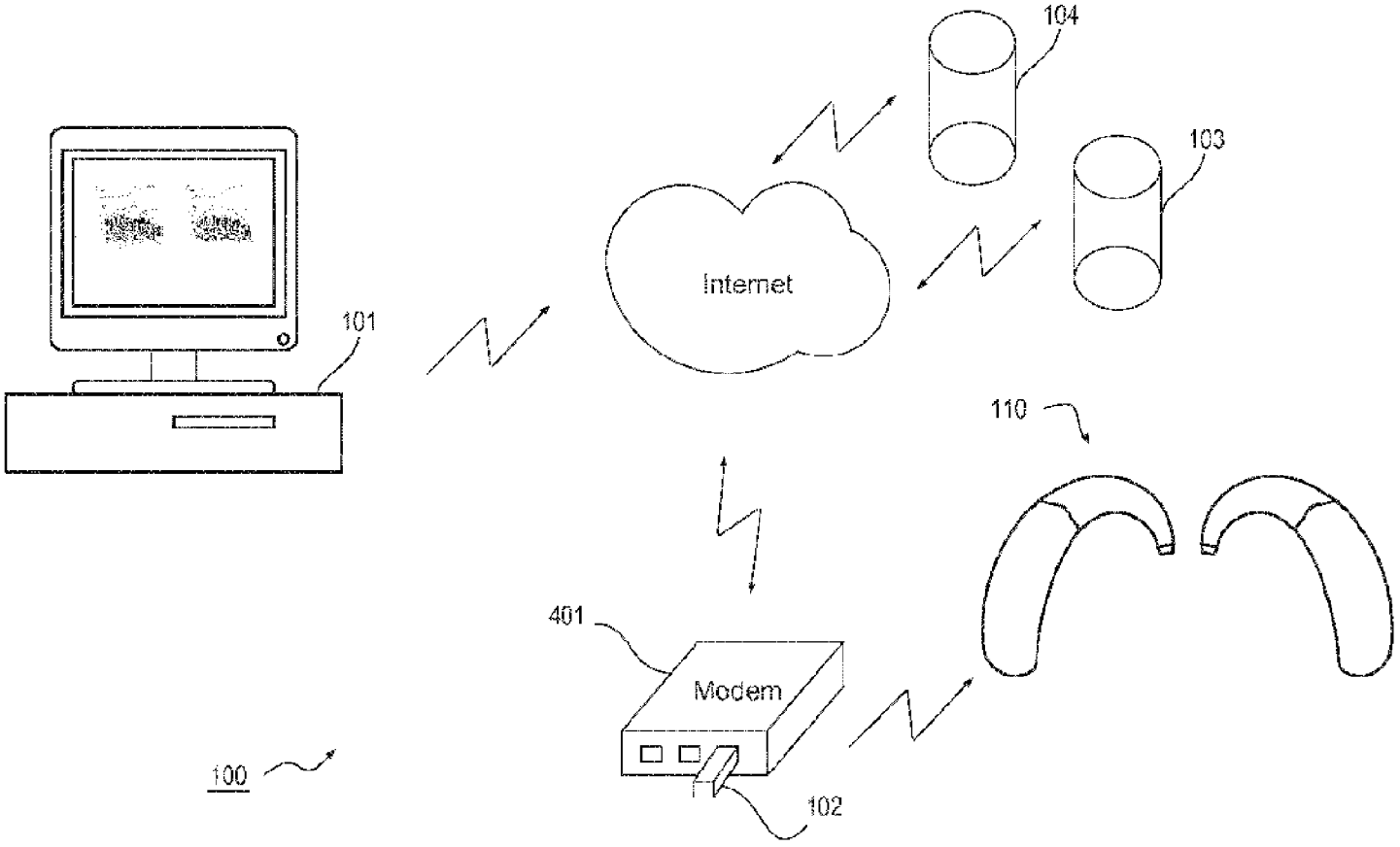
FIG. 4 illustrates in a more graphical manner a hearing aid fitting system according to the first embodiment of the invention.

Reference is finally made to FIG. 4 which illustrates in a more graphical manner the hearing aid fitting system 100 according to the first embodiment of the invention.

The hearing aid fitting system 100 comprises a client 101, an external device 102, a control server 103, a hearing aid user database server 104 and a hearing aid system 110.

Additionally a standard modem 401 is illustrated, whereto the external device 102 is connected using an Ethernet connection. In variations any computer network connection can be used.

In variations according to the disclosed embodiments the external device 102, 302 comprises a unique device identification that is provided to a basic communication establishing server that based on said unique device identification enables the external device 102, 302 to provide the unique hearing aid system identification to a specific one among several control servers, whereby an efficient arrangement of the control servers can be achieved.

In other variations according to the disclosed embodiments, the external device is not implemented as an embedded device. Within the present context an embedded device is defined by being designed only for carrying out specific functions within a larger system. By contrast, a general-purpose computer, such as a personal computer (PC), is designed to be flexible and to meet a wide range of end-user needs.

In variations according to the all the disclosed embodiments the Ethernet protocol and connections may be substituted with other suitable computer network protocols, such as e.g. the Transmission Control Protocol (TCP) or the User Datagram Protocol (UDP), and connections.

In still another variation of the disclosed embodiments, the communication channel between the client 101 and the external device 102 is established using Transmission Control Protocol (TCP) or User Datagram Protocol (UDP) hole punching, mediated by the control server 103.

In yet other variations of the disclosed embodiments, additional functionality can be added, such that e.g. a hearing aid fitter can be available for hearing aid users visiting an internal device positioned at e.g. a public institution or a remote room in a hearing aid clinic and automatically will receive an alert when the external device has connected to a hearing aid system. This can e.g. be done by: using the client to provide information to the control server that the client is available for assisting one specific or a multitude of external devices, by using the external device to provide information to the control server when a hearing aid system is detected by one of said external device, e.g. by positioning the hearing aid system within wireless range of the external device, and by using the control server to alert the client and thus the hearing aid fitter of this event.

According to still another advantageous use of the hearing aid fitting system a software application, such as e.g. a smart phone application, can be adapted to provide the information to the control server that a hearing aid system has been connected to a specific external device, whereby this extra functionality needs not be included in the external device.

In a further advantageous use another software application, such as e.g. a smart phone application, can be adapted to provide the information from the control server and to a hearing fitter that a hearing aid system has been connected to one of the external devices that the hearing aid fitter is responsible for. This can be implemented in a simple manner by linking, in the control server, identification of the hearing aid fitter, which is set to be responsible for said external devices with a given smart phone identification.

We claim:

1. A hearing aid fitting system, adapted for remote fitting of a hearing aid, comprising a client, an external device, a control server, a look-up data structure, and a communications link, wherein the client, external device, control server, look-up data structure and hearing aid are adapted to communicate by said communications link;

wherein said look-up data structure is configured to allow a unique device identification to be searched based on a multitude of search term types;

wherein said client comprises fitting software configured to fit a hearing aid, a selector configured to select a unique device identification using said look-up data structure, and connection software configured to connect to said control server, to provide to said control server a current computer network address of the client, the selected unique device identification and a hearing aid fitter identification, and to request said control server to establish a direct communication channel between said client and the external device having said unique device identification for the person holding said fitter identification;

wherein the external device comprises a unique device identification, external device software application configured to provide said unique device identification and a current computer network address of the external device to said control server, and a redirector configured to direct the content of the data transmitted over said direct communication channel to the hearing aid system;

wherein said control server comprises an interface configured to provide the direct communication channel between the client and the external device based on the current computer network addresses and the selected unique device identification and based on an evaluation of whether the hearing aid fitter holding said hearing aid fitter identification is entitled to access the external device having said unique device identification.

2. The hearing aid fitting system according to claim 1, wherein said multitude of search term types includes at least two types from the group consisting of: name of hearing aid user, name of hearing aid fitting clinic, name of specific location in a hearing aid fitting clinic, name of hearing aid fitter and name of public institution.

3. The hearing aid fitting system according to claim 1, wherein said external device is adapted to allow storage of specific hearing aid fitter identifications, and wherein said interface of the control server is adapted such that the evaluation, in order to allow access to the external device, comprises a comparison of the identification of a hearing aid fitter requesting access and a hearing aid fitter identification stored in the external device.

4. The hearing aid fitting system according to claim 1, wherein said client is granted access to said hearing aid fitter identification based on a user log-in.

5. The hearing aid fitting system according to claim 1, wherein said selector and said software application are integrated as part of the fitting software.

6. The hearing aid fitting system according to claim 1, wherein said look-up data structure is arranged as at least one independent server.

7. The hearing aid fitting system according to claim 1, wherein said external device is an embedded device.

8. The hearing aid fitting system according to claim 1, wherein said external device is configured such that the only possible user interaction is to insert the external device into a computer network connector.

9. The hearing aid fitting system according to claim 1, wherein said unique device identification is a unique hearing aid system identification that has been retrieved by the external device.

10. The hearing aid fitting system according to claim 1, wherein said unique device identification is a unique external device identification.

11. The hearing aid fitting system according to claim 1, wherein said look-up data structure is adapted such that some of said search terms allow a unique hearing aid system identification to be found, and other of said search terms allow a unique external device identification to be found.

12. The hearing aid fitting system according to claim 1, wherein said client comprises two sub parts: a thin client comprising a web browser and a fitting server part comprising the fitting software, the corresponding graphical user interface and the fitting connection software being adapted to request the control server to establish the direct communication channel between the server part of the client and the external device.

13. The hearing aid fitting system according to claim 12, wherein said thin client comprises a wireless Ethernet access point whereby said external device can connect to the internet through said client.

14. A method of fitting a hearing aid system comprising the steps of:

providing a client, a look-up data structure, an external device, a control server and a hearing aid system;

using the client and the look-up data structure to select a unique device identification;

using the client to provide the selected device identification, a current computer network address of the client and a hearing aid fitter identification to the control server;

using the external device to provide the unique device identification and a current computer network address of the external device to the control server;

using said client to request the control server to establish a direct communication channel between the client and the external device;

using the control server to evaluate whether the hearing aid fitter holding said hearing aid fitter identification is entitled to access the external device having said unique device identification;

using the control server to establish the direct communication channel between the client and the external device; and using the client, the direct communication channel and the external device to remotely fit the hearing aid system.

15. The method according to claim 14, comprising the steps of storing the hearing aid fitter identification in the external device, and wherein said step of evaluating whether the hearing aid fitter holding said hearing aid fitter identification is entitled to access the external device having said unique device identification comprises the further step of comparing the identification of a hearing aid fitter requesting access and a hearing aid fitter identification stored in the external device.

16. The method according to claim 14, wherein the step of using the client to provide hearing aid fitter identification to the control server comprises a step of:

obtaining said hearing aid fitter identification based on a user log-in.

* * * * *